US009205966B2

(12) United States Patent
Kunz et al.

(10) Patent No.: US 9,205,966 B2
(45) Date of Patent: Dec. 8, 2015

(54) DEVICE FOR STORING AND SUPPLYING BALANCING WEIGHTS TO A BALANCING SYSTEM

(71) Applicant: Wegmann automotive GmbH & Co. KG, Veitshöchheim (DE)

(72) Inventors: Herwig Kunz, Veitshöchheim (DE); Dietmar Wagenschein, Veitshöchheim (DE)

(73) Assignee: Wegman Automotive GmbH & Co. KG, Veitshöchheim (DE)

( * ) Notice: Subject to any disclaimer, the term of this patent is extended or adjusted under 35 U.S.C. 154(b) by 172 days.

(21) Appl. No.: 13/847,034

(22) Filed: Mar. 19, 2013

(65) Prior Publication Data

US 2013/0248409 A1 Sep. 26, 2013

(51) Int. Cl.
*B65D 73/00* (2006.01)
*B65D 75/02* (2006.01)

(52) U.S. Cl.
CPC ..... *B65D 75/02* (2013.01)

(58) Field of Classification Search
CPC ..... B65D 73/0064; B65D 73/02; B65D 73/0014; A61F 17/00
USPC ..... 206/477, 478, 479, 483, 338; 2/220, 2/307, 273; 221/72
See application file for complete search history.

(56) References Cited

U.S. PATENT DOCUMENTS

| | | | | |
|---|---|---|---|---|
| 2,929,425 | A * | 3/1960 | Slaughter | 206/521 |
| 3,823,818 | A * | 7/1974 | Shaw | 206/390 |
| 5,248,036 | A * | 9/1993 | Radocha et al. | 206/479 |
| 5,860,561 | A * | 1/1999 | Saldana et al. | 221/25 |
| 2012/0010552 | A1 * | 1/2012 | Greer et al. | 604/1 |

* cited by examiner

*Primary Examiner* — Luan K Bui
*Assistant Examiner* — Rafael Ortiz
(74) *Attorney, Agent, or Firm* — Yakov Sidorin; Quarles & Brady LLP

(57) ABSTRACT

A device for storing balancing weights and for supplying said weights to a balancing system, includes at least one carrier belt which is flexible at least in a main plane for accommodating balancing weights which are arranged consecutively in the longitudinal direction of said belt. The carrier belt includes a hinge arrangement between two belt sections provided for accommodating a balancing weight, said hinge arrangement being pivotable in the main plane in both directions and permitting a folding back onto itself. As a result, the carrier belt can be stored in zigzag layers in an approximately cuboid container, thus enabling storage, transport and compact configuration of the device in accordance with the invention.

5 Claims, 8 Drawing Sheets

DEVICE FOR STORING AND SUPPLYING BALANCING WEIGHTS TO A BALANCING SYSTEM

CROSS-REFERENCE TO RELATED APPLICATIONS

This application claims priority from and benefit of German Patent Application No. 10 2012 204 706.9 filed on Mar. 23, 2012, the entire disclosure of which is incorporated herein by reference.

TECHNICAL FIELD

The present invention relates to a device for storing and for supplying balancing weights to a balancing system preferably for balancing of vehicle wheels.

BACKGROUND

Devices for storing and for balancing weights to a balancing system are often used in the production of cars. So-called endless carrier belts are equipped with the balancing weights and packed into package containers from where they are taken continuously at the location of their use, i.e. at the balancing system, and are supplied to said system. A relevant problem is the problem of packing of the carrier belts (which are equipped with the balancing weights) in the most compact manner in order to enable space-saving storage on the one hand and compact configuration of the storage and feed device on the other hand.

In a first embodiment, the balancing weights are arranged on a tape which is adhesive on both sides and is protected on the bottom side by a peel-off strip; this tape forms the carrier belt. In the balancing system, the balancing weights are severed together with the associated tape section and glued onto the component to be balanced after removal of the protective strip. In another embodiment, the balancing weights are arranged on and fixed to a separate carrier belt, which belt is either reusable or is disposed after removal of the balancing weights.

The European patent application publication EP 1 245 940 A2 discloses balancing weights arranged in a comparatively tight packing on a tape that is adhesive on both sides. In order to enable the attachment of a balancing weight (which may be formed by one or several individual weights) to the curved inside or outside of the edge of a wheel rim, the tape used as the carrier belt is slightly elastic to facilitate the adjustment of the distance between the individual weights required to accommodate the curvature of the wheel rim. The ways of storing the so-structured tape are very limited: this embodiment can be stored only in a manner that the tape equipped with the balancing weights is wound on a coil with the balancing weights on the outside. Due to the circular shape of the coil, space-saving storage, space-saving transport and compact configuration of the feed device is complicated and difficult.

SUMMARY

The embodiments of the invention are directed to a device for storing and for supplying balancing weights to a balancing system, which allows space-saving packing and compact configuration of a carrier belt equipped with the balancing weights.

In a first embodiment, a device for storing balancing weights and for administering said weights to a balancing system, includes a carrier belt element which is flexible at least in a main plane directed to accommodate balancing weights. The term "main plane" designates the plane in which the carrier belt is pivoted and/or folded. The balancing weights are arranged sequentially along the longitudinal direction of the belt element. The carrier belt element includes a hinging means or hinge-like arrangement between two belt sections provided for accommodating a balancing weight, said hinge arrangement being pivotable in the main plane in first and second directions and permitting the belt element to fold back onto itself.

The folding back to itself requires bending of the belt element by substantially 180 degrees. This can either be realized in the manner that each hinging means allows for bending by 180 degrees, or that the overall bending span of 180 degrees is achieved aggregately, by having each of two or more of the hinging means provide for bending of the belt at an angle that is smaller than 180 degrees, thereby distributing the bending among two or more hinging means.

The embodiments preferably allow for accommodating a carrier belt equipped with balancing weights in compact zigzag layers, so that it can be packed into a cuboid container, which allows space-saving storage and a more compact configuration of the feed device. The term "main plane" designates the plane in which the carrier belt is pivoted or folded.

In an embodiment, the carrier belt is arranged as a flat flexible tape in a main plane that is disposed transversely and, in a specific case, substantially perpendicularly to the tape plane. The belt element is equipped with a loop for accommodating a balancing weight between two respective tape sections on the tape which are used as hinge arrangements. To remove the balancing weight element, the element can be detached from the loop or the loop can be destroyed. The loop can be arranged as a tape loop formed by a bottom tape and an upper tape. According to another embodiment, the loop is arranged from one or several adjacent cords which are plaited in the longitudinal direction into the tape.

In its common form, a balancing weight element is provided with a notch for accommodating a mounting clamp or clip. In this case, the embodiment provides that the loops will respectively engage in such notches so that the balancing weights on the associated carrier belt will additionally be held in an interlocked manner.

In accordance with another embodiment, the carrier belt element includes at least one strand of pockets, which are arranged behind one another and are connected with one another with flexible connectors such as flexible cords, foe example, to accommodate a respective end of an associated balancing weight. The pockets are dimensioned in such a way that they tightly enclose and hold the ends of the balancing weights. Especially secure holding of the balancing weights is further achieved when both ends of the balancing weights are assigned to such a strand as shown in the embodiment.

A specific type of balancing weights are provided with at least one through-hole which penetrates the balancing weight. In a further embodiment, the carrier belt element is formed by respective cords which are threaded continuously through the through-holes of the successively arranged balancing weights. The threading of the cords through the through-holes is fashioned in such a way that the balancing weights are prevented from slipping along the cords in the longitudinal direction. In accordance with another embodiment, formatted for use with balancing weights having at least one through-hole, the carrier belt is structured as a flat flexible tape is disposed in a main plane perpendicularly to the tape plane and including holding pins. The holding pins are respectively associated with the through-holes of the balancing weights and disposed perpendicularly to the tape plane. The holding pins are dimensioned to securely hold the balancing weights by clamping and/or by means of enlargements formed on the holding pins.

According to a further embodiment, the carrier belt includes clamps which are arranged consecutively (one behind one another), are connected with one another in an articulated manner, include wire(s) and respectively include a clamp bracket holding an associated balancing weight. In the event that the balancing weights are provided with one or several through-holes, each of the clamps may include a holding projection and/or a holding indent which engages with the associated through-hole to additionally secure the balancing weight.

BRIEF DESCRIPTION OF THE DRAWINGS

In the following, the invention will be described by way of example, without limitation of the general inventive concept, on examples of embodiment and with reference to the drawings.

Figure 1:
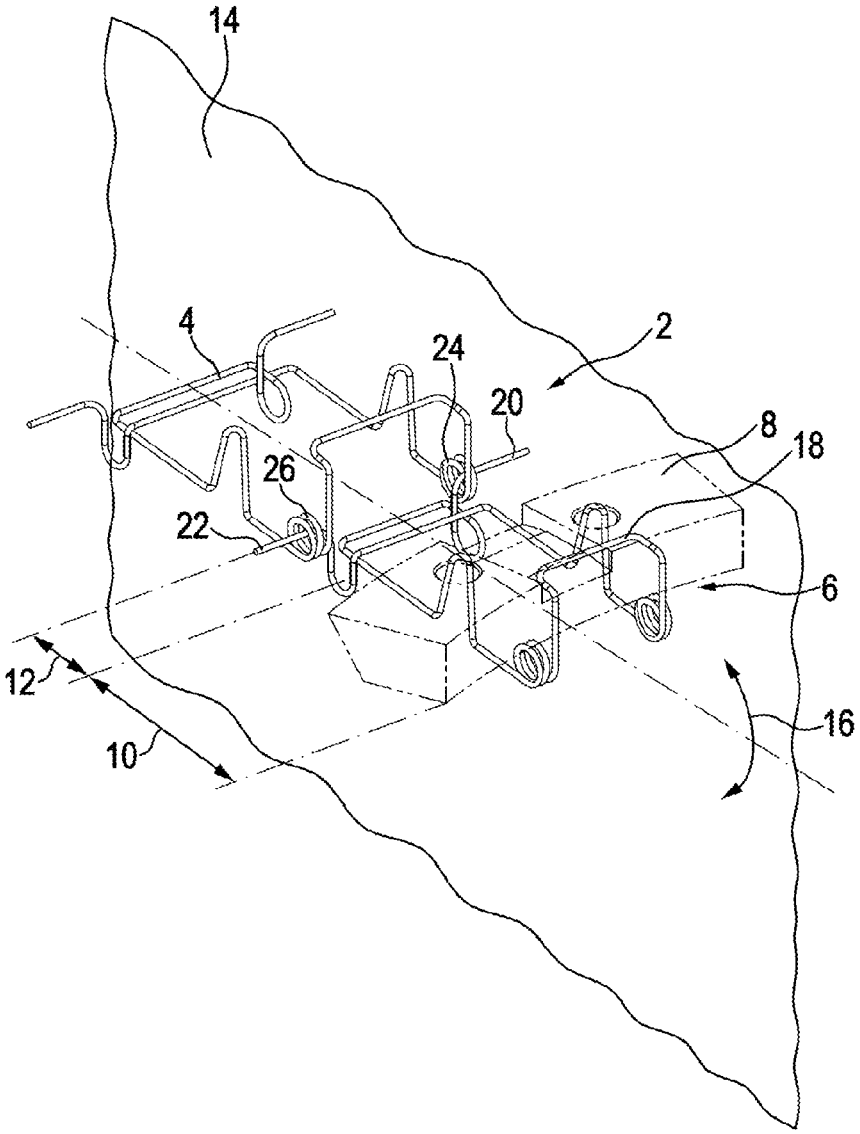
FIG. 1 shows a perspective view of a section of a carrier belt element formed by clamps, with a balancing weight indicated in juxtaposition with the carrier belt element.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

FIG. 1 shows a device according to a first embodiment. The carrier belt 2 as shown here contains a plurality of clamps 4, 6, which are arranged behind one another and are preferably made of a resilient wire material. Each of clamps 4, 6 forms (i) a front belt section 10 dimensioned to accommodate a corresponding balancing weight 8 and (ii) a hinge arrangement 12 which cooperates with a subsequent clamp and which allows the carrier belt 2 to bend in the main plane. The main plane is designated with reference numeral 14; the two-directional bending of the carrier belt element 2 is indicated by a double arrow 16. This allows the carrier belt 2 to be folded back onto itself in both directions, and the folded carrier belt can be stored in a zigzag folding manner in an receiving container, for example a cuboid container or a container that is a rectangular parallelepiped. If the hinge arrangement is structured to facilitate bending by up to 180 degrees, the folding-back of the carrier belt can occur in one step, i.e. by way of one single hinge arrangement. It is also possible that the hinge arrangement only allows bending of the belt at a smaller angle such as 90 degrees for example, so that the folding-back of the belt will be distributed among two following hinge arrangements etc. As shown in FIG. 1, each of the clamps 4, 6 includes in the front region a clamping bracket 18 that engages the balancing weight 8 over its edge and holds said weight. Each of the clamps 4, 6 additionally includes in the rear region two outwardly bent hinge pins 20, 22, which engage the respectively associated hinge eyes 24, 26 of next, following clamp and thereby form the hinge arrangement 12.

Figure 2:
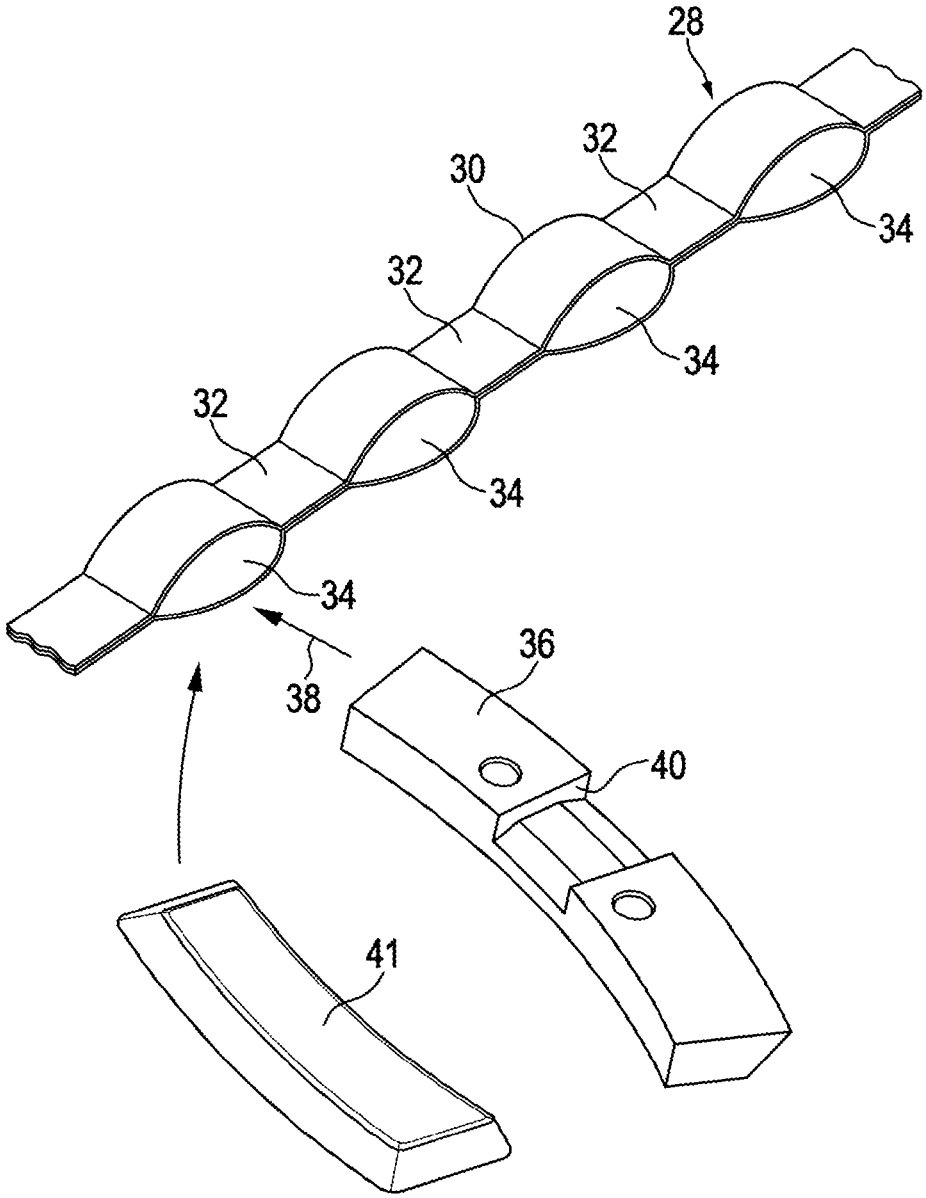
FIG. 2 shows a perspective view of a carrier belt formed as a tape with tape loops, with a balancing weight shown positioned for insertion into a tape loop.

FIG. 2 shows a flexible tape 30 which forms a carrier belt 28, is disposed in a main plane that is substantially perpendicularly to the tape plane, and includes tape sections 32 (structured as hinging means) and tape loops 34 (formed between two immediately consecutive hinging means) to accommodate balancing weights 36. The balancing weights 36 can be introduced into the tape loops 34 in the direction of arrow 38. In order to remove the balancing weights 36 from the loops, the weights are either pulled laterally out of the tape loops 34, or the tape loops 34 are destroyed so as to release the balancing weights 36. The balancing weights 36 are illustrated in this case by way of example as weights with a middle notch 40 dimensioned to accommodate a mounting clamp that affixes to a wheel rim. It is understood however that especially in the embodiments according to FIGS. 1 to 5 it is also possible to use any other form of balancing weights, e.g. generally known self-adhesive balancing weights of the type as designated with reference numeral 41.

Figure 3:
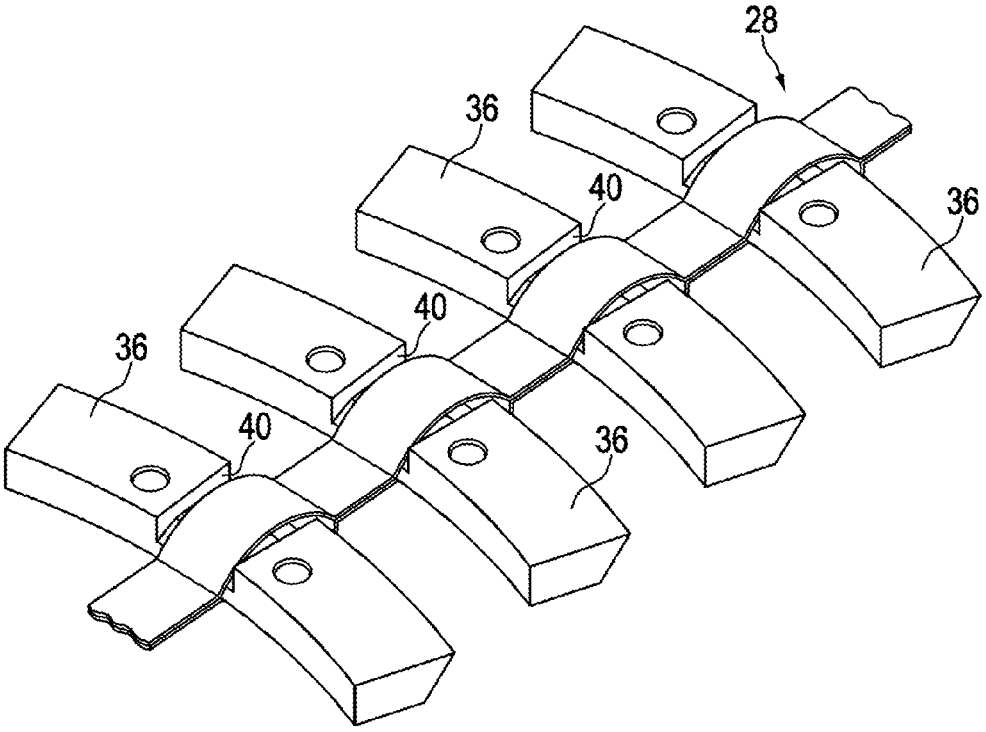
FIG. 3 shows an embodiment of FIG. 2 with balancing weights disposed inside the tape loop.

FIG. 3 shows a carrier belt 28 according to the embodiment of FIG. 2 with several balancing weights 36 already inserted into the tape loops. As shown in FIGS. 2 and 3, the balancing weights 36 are respectively provided with a central notch 40 for accommodating a mounting clamp, with the tape loops 34 engaging these notches 40 of the mounted balancing weights 36 to ensure operationally strong lateral hold of the weights.

Figure 4:
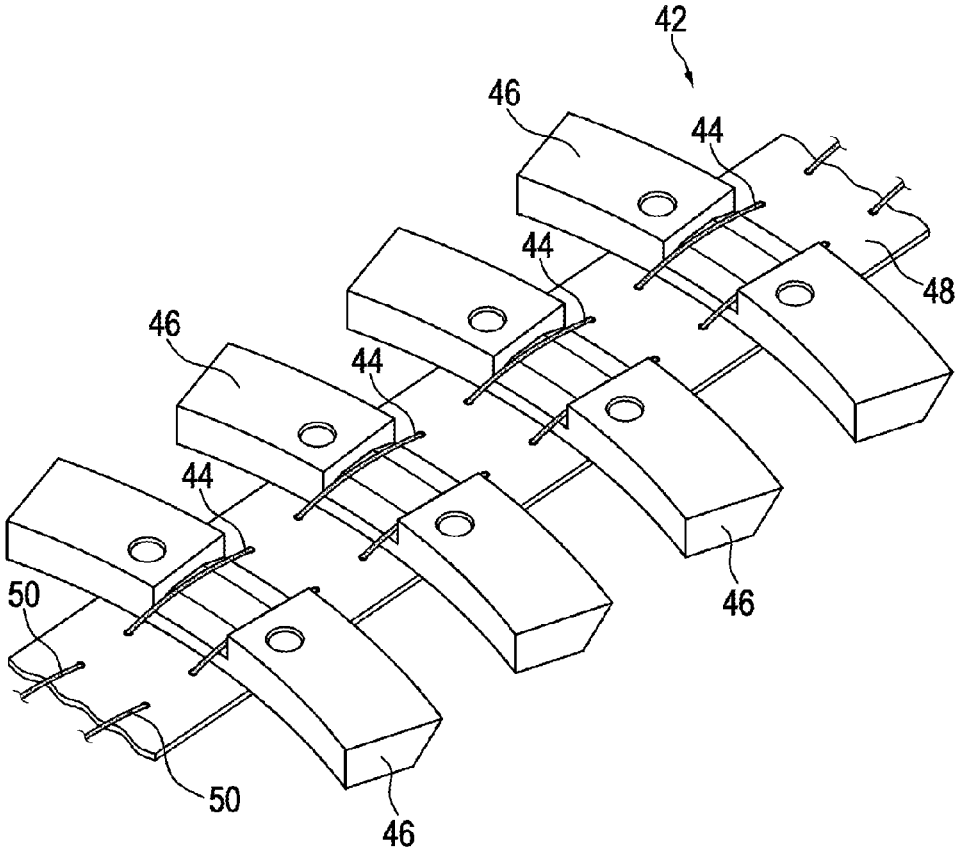
FIG. 4 shows an embodiment of the carrier belt formed by a tape with cord loops and holding balancing weights therein.

FIG. 4 shows a carrier belt 42 similar to the one of FIG. 3, with cord loops 44 for holding the balancing weights 46 being formed from two adjacently disposed cords 50 which are plaited in the longitudinal direction into the tape 48.

Figure 5:
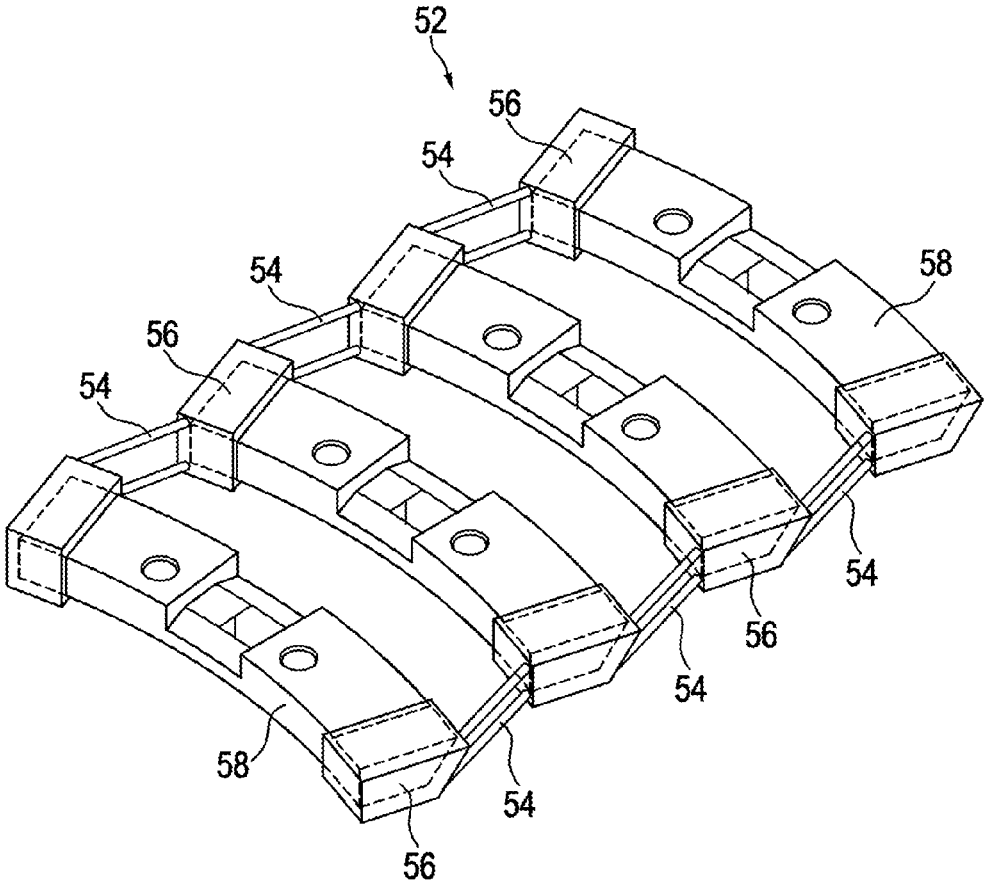
FIG. 5 shows an embodiment of the carrier belt formed by two strands of pockets arranged behind one another, a pair of two corresponding pockets from the two strands respectively accommodating a balancing weight.

FIG. 5 shows a carrier belt 52 which includes two strands of successively arranged pockets 56 connected with each other by flexible connectors 54 such as cords, for example, to accommodate the respective end of an associated balancing weight 58. As already explained above, the pockets 56 are dimensioned in such a way that they tightly enclose the ends of the balancing weights 58 and securely hold the same.

Figure 6:
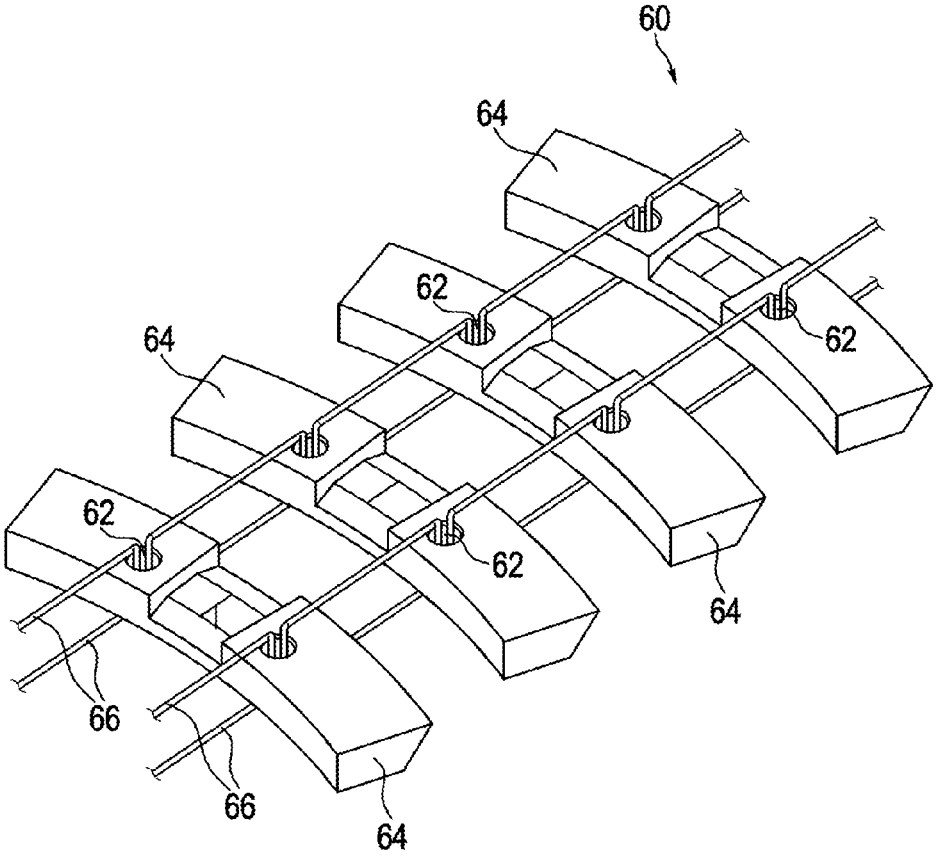
FIG. 6 shows a carrier belt made of cords threaded through through-holes of the balancing weights.

FIG. 6 shows a carrier belt 60 which is formed by cords 66 which are threaded continuously through through-holes 62 of the successively arranged balancing weights 64. In order to ensure that the balancing weights 64 are unable to displace in the longitudinal direction, the cords 66 engage into each other within the through-holes 62 in the manner of a machine seam, i.e. the bottom one of the cords engages in a loop of the upper cord.

Figure 7:
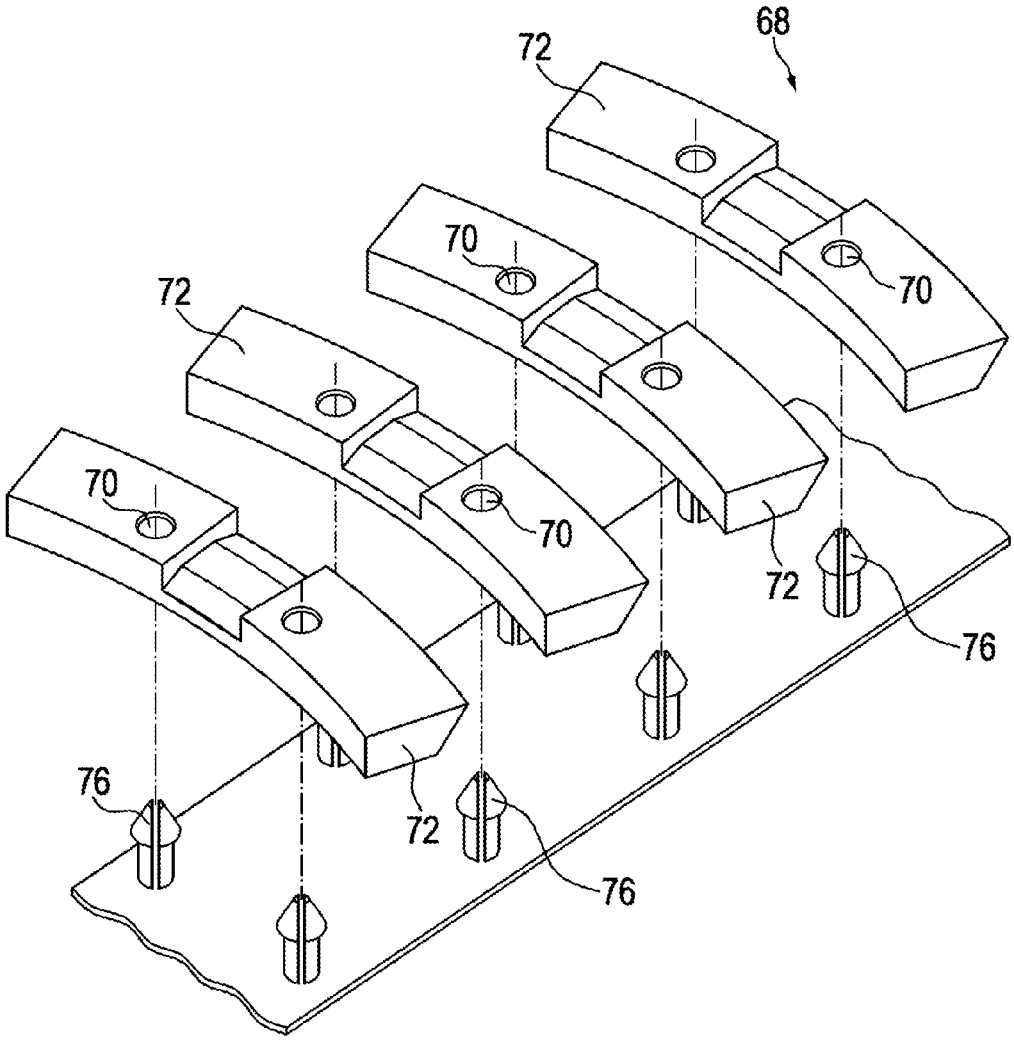
FIG. 7 shows a carrier belt including a tape with holding pins disposed perpendicularly to the tape plane and engaging in through-holes of the balancing weights.

FIG. 7 shows a carrier belt 68 especially for balancing weights 72 which are provided with through-holes 70. The carrier belt 68 is arranged as a flat tape 74 with holding pins 76 which respectively engage into the through holes 70 and are disposed perpendicularly to the tape plane. The holding pins 76 are dimensioned to engage the through-holes with tight fit and can thereby securely hold the balancing weights 72. As is shown in FIG. 7, the holding pins 76 can contain slits and be provided with enlargement at the ends, so that the balancing weights 72 can be clipped onto said pins.

Figure 8:
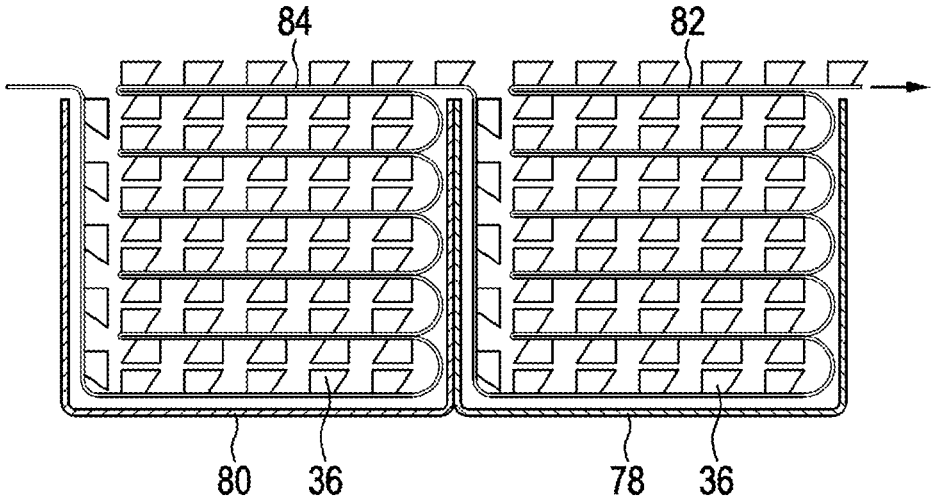
FIG. 8 schematically shows an embodiment of a carrier-belt storage including two containers arranged behind one another with carrier belts arranged in zigzag layers.

FIG. 8 shows a schematic side view of two containers 78, 80 which are arranged behind one another and in which one respective carrier belt 82 and 84 is housed in zigzag folding enabled by the hinge arrangement as described above. The front end of the rear carrier belt 84 is suitably connected with the rear end of the front carrier belt 82, so that the carrier belts 82 and 84 can be supplied to the balancing system (not shown) without any standstill caused by a change of tape. In the embodiment according to FIG. 1, the connection of a carrier belt with the subsequent one simply occurs in such a way that the hinge pins 22 of a preceding clamp are introduced by lateral compression of said pin into the hinge eyes 26 of a subsequent clamp, so that this produces a connection with a hinge arrangement between the successive carrier belts.

It will be appreciated to those skilled in the art having the benefit of this disclosure that this invention is believed to provide a device for storing and for supplying balancing weights to a balancing system. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

2 Carrier belt
4 Clamp
6 Clamp
8 Balancing weight
10 Belt section
12 Hinge arrangement
14 Main plane
16 Double arrow
18 Clamp bracket
20 Hinge pin
22 Hinge pin
24 Hinge eye
26 Hinge eye
28 Carrier belt
30 Tape
32 Hinge arrangements
34 Tape loops
36 Balancing weights
38 Arrow
40 Notch
42 Carrier belt
44 Cord loops
46 Balancing weights
48 Tape
50 Cords
52 Carrier belt
54 Cords
56 Pockets
58 Balancing weight
60 Carrier belt
62 Through-holes
64 Balancing weights
66 Cords
68 Carrier belt
70 Through-holes
72 Balancing weights
74 Tape
76 Holding pins
78 Container
80 Container
82 Carrier belt
84 Carrier belt

What is claimed is:

1. A device comprising:

one or more balancing weights, each balancing weight including a bar, the bar having a body, upper and lower surfaces, and a notch defined in a central portion of the body by the upper surface;

at least one carrier belt including a plurality of belt sections, each belt section structured to accommodate a balancing weight from said one or more balancing weights in a sequence along a longitudinal direction of the at least one carrier belt, the at least one carrier belt being flexible in a main plane;

wherein the carrier belt includes a flexing means between two immediately sequential belt sections, said flexing means being flexible in the main plane in first and second directions to permit a folding of the at least one carrier belt back onto itself, and wherein the upper surface includes first and second flat portions and a portion defining the notch between the first and second flat portions.

2. The device according to claim 1, wherein the at least one carrier belt includes a flat flexible tape, the at least on carrier belt being equipped with a loop located between and adjacent to two tape sections of the tape, said tape sections being structured as the flexing means, said loop being dimensioned to hold a balancing weight therein when a portion of the loop is within bounds of the notch.

3. The device according to claim 2, wherein the loop is defined as a tape loop formed by a bottom tape and an upper tape of the at least one carrier belt.

4. The device according to claim 2, wherein a balancing weight from said one or more of balancing weights has a polygonal cross-section.

5. The device according to claim 1, wherein the main plane is transverse to a plane of the at least one carrier belt.

* * * * *